US005475462A

United States Patent [19]

Fyson

[11] Patent Number: 5,475,462

[45] Date of Patent: Dec. 12, 1995

[54] PHOTOGRAPHIC PROCESSES

[75] Inventor: John R. Fyson, Hackney, England

[73] Assignee: Eastman Kodak Company, Rochester, N.Y.

[21] Appl. No.: 226,790

[22] Filed: Apr. 12, 1994

[30] Foreign Application Priority Data

Apr. 13, 1993 [GB] United Kingdom ..... 9307512

[51] Int. Cl.[6] ..... G03D 3/08

[52] U.S. Cl. ..... 354/320; 354/322

[58] Field of Search ..... 354/319–324; 355/27, 28, 100

[56] References Cited

U.S. PATENT DOCUMENTS 3,331,276 7/1967 Oliver ..... 355/100

4,300,828 11/1981 Kaufmann ..... 354/322

4,575,209 3/1986 Zwettler ..... 354/322

*Primary Examiner*—D. Rutledge

*Attorney, Agent, or Firm*—Frank Pincelli

[57] ABSTRACT

In conventional photographic processes, material being processed follows a predetermined sequence of steps, for example, developer, bleach, first wash, fixer, second wash, and stabilizer. This requires the provision of at least two wash tanks as the film is traditionally processed by following a fixed path through the processor. This makes the processor bulky as the wash tanks need to be repeated. Described herein is a process in which more than one wash step can be accommodated using a single wash tank.

3 Claims, 2 Drawing Sheets

PHOTOGRAPHIC PROCESSES

FIELD OF THE INVENTION

This invention relates to photographic processes for processing photographic material and is more particularly concerned with the use a particular processing stage more than once.

BACKGROUND OF THE INVENTION

In conventional photographic processing apparatus for processing of photographic material, the material being processed follows a predetermined sequence of steps through the apparatus. For example, when processing a conventional color negative film using the C-41 process, the film follows these processing steps: developer, bleach, first wash, fixer, second wash, and stabilizer.

In conventional processing apparatus, this requires the provision of at least two wash tanks as the film is traditionally processed by following a fixed path through the processor. The use of wash water between processing steps as discussed above is described in GB-A-1 493 170 and DE-A-34 23 671.

Prewashing baths are also known in the art. For example, JP-A-62 38465 discloses the use of a prewash bath between the developing step and the wash step, and JP-A-63 143548 discloses the use of a preliminary wash tank between the fixing step and the wash step.

It is also known in the art to have more than one washing step and the water from a later wash step is recovered for use in an earlier wash step. This is discussed in JP-A-62 38465 mentioned above, and also in GB-A-2 062 265 and EP-A-0 512 321.

However, in the apparatus used to carry out the processes discussed above, more than one wash tank is always provided.

With the advent of minilabs and the need to make processing apparatus smaller, it was found that the first wash step could be removed from the C-41 process for processing of color negative film as discussed above. This made the process quicker and the apparatus shorter as one less wash tank is required.

However, there are several disadvantages associated with the removal of this first wash step:

1) The fixer solution becomes contaminated with bleach. In particular, bromide is carried in from the bleach which makes the fixing step slower. Iron complexes also carried in from the bleach make electrolytic silver recovery processes from the fixing solution using conventional means less efficient.

2) The developer raises the pH of the bleach. In processing of color negative film, the bleaching step is usually acidic and the developing step alkaline. Developer carried over into the bleaching step from the previous step, increases the bleaching time due to the raised pH of the bleach.

3) Dye stains form in the film. This is due to the developer being oxidized in the bleach and reacting with the couplers in all areas of the film which is not imagewise dependent.

4) High levels of pollutants in the effluent from the process. This is because acid is added to the bleach to prevent dye stain formation by neutralization of the coupler anions in the film. The acid usually used is acetic acid which produces high levels of biological oxygen demand (often expressed as $BOD_5$) in the effluent.

SUMMARY OF THE INVENTION

It is therefore an object of the present invention to provide an improved photographic process in which the problems mentioned above are overcome.

It is a further object of the present invention to provide photographic processing apparatus which is shorter than conventional apparatus and which allows complete processing of the material without the disadvantages mentioned above.

In accordance with one aspect of the present invention, there is provided a method of processing photographic material which comprises two or more processing steps, characterized in that the material is processed again in at least one previously visited processing step.

ADVANTAGEOUS EFFECT OF THE INVENTION

This means that only a single tank is needed for each processing step, for example, a single wash tank can be used for several wash steps and the material being processed is directed to this tank for each of these wash steps.

Furthermore, by providing a wash step in between other processing steps, carry over from one processing solution to another is substantially reduced. This is particularly advantageous where the first processing solution is likely to contaminate the second. For example, bleach could be removed from the material after the bleach step in a wash step prior to the material entering the fixing step. This would make fixing step faster and silver recovery easier.

Moreover, a more compact processing apparatus can be provided and the material being processed can be directed into any processing tank as required. For example, the processing apparatus can be configured to have the following tanks: developer; bleach; fixer; wash and stabilizer.

Copending U.S. Ser. No. 08/239,179, filed May 6, 1994; U.S. Ser. No. 08/226,616, filed Apr. 12, 1994; U.S. Ser. No. 08/226,729, filed Apr. 12, 1994, entitled "Photographic Processing Apparatus" which has issued to U.S. Pat. No. 5,400,104, and copending U.S. Ser. No. 08/227,210, filed Apr. 12, 1994, entitled "Photographic Apparatus", describe apparatus which can be used for carrying out the method of the present invention. In all four of these applications, the material being processed can either be directed to any processing step in any desired order, or be processed by the application of any processing solution in any desired order.

Moreover, for color negative processing, it is possible to retain the wash step between the bleach and the fixer and provide apparatus of the same size as one without that step. In particular, this wash makes silver recovery from the fixer easier and reduces the amount of sequestering agent which must be added to prevent precipitation of iron. The amount of sulfite which needs to be added to the fixer to stabilize the thiosulphate is also reduced.

By having a wash step which can be placed between any two other processing steps, for example, the developer and the bleach, little or no alkali from the developer will be carried into the bleach and therefore less acid is required to maintain a sufficiently low pH to prevent continued coupling and maintain good bleaching rates.

BRIEF DESCRIPTION OF THE DRAWINGS

For a better understanding of the present invention, reference will now be made, by way of example only, to the accompanying drawings wherein.

DETAILED DESCRIPTION OF THE INVENTION

Figure 1:
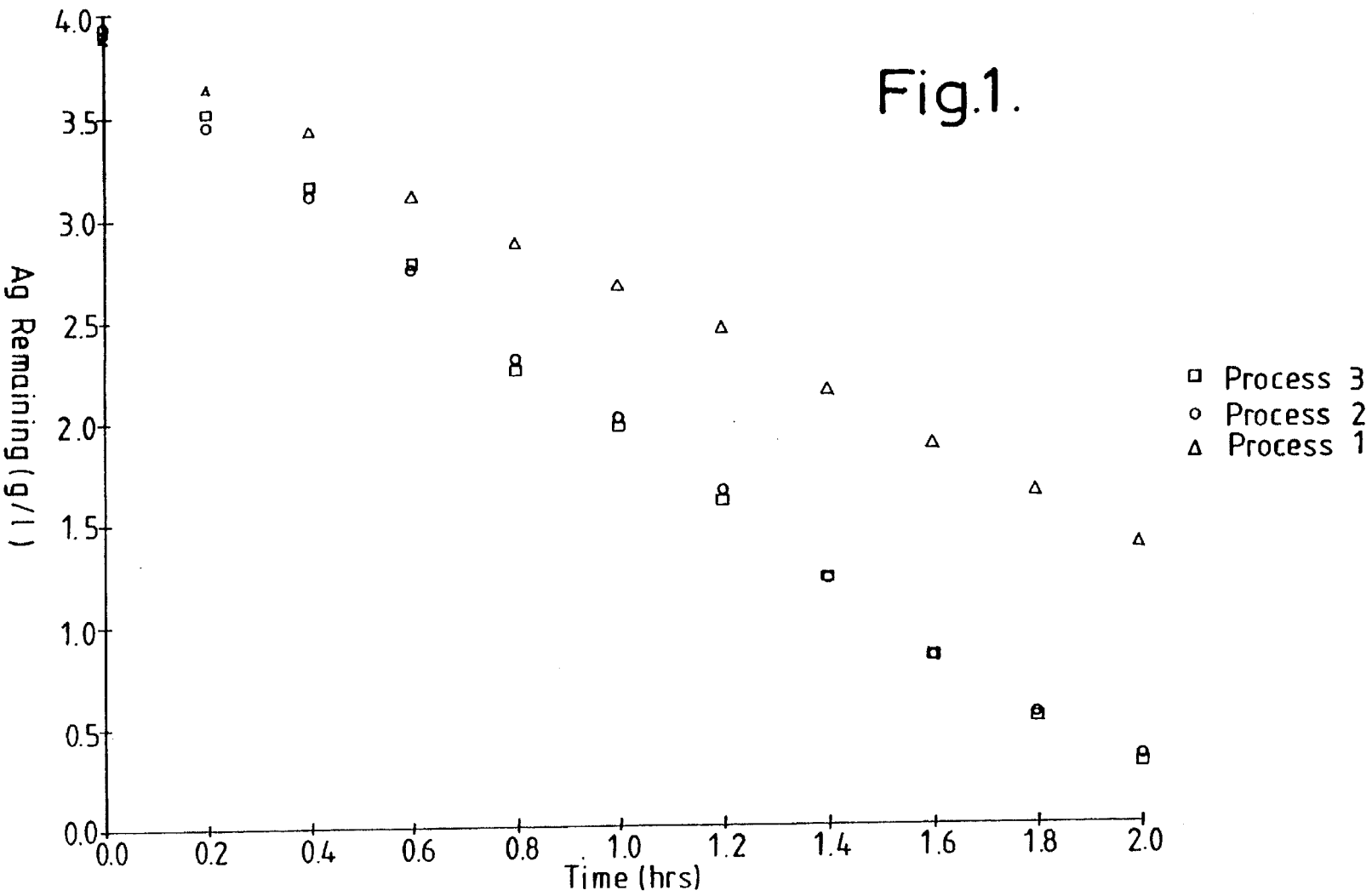
FIG. 1 is a plot of silver against time for three comparative processes.

Experiments were carried out to give a comparison between known processes and that of the present invention. Various parameters were measured for each process. KODACOLOR GOLD 400 film was used for these comparative experiments.

Initially, it was found by experiment that a piece of KODACOLOR GOLD 400 film carried over approximately 2 ml/m (0.6 ml/ft) from one processing tank to the next. From this and knowing the aim replenishment rates for the C-41 color negative film process, a pseudo seasoned C-41 process was made up.

This was done by mixing 0.6 ml from the previous tank with an amount of replenisher equal to the replenishment rate for the tank which was being made up. Naturally, the replenishment rate depends on the tank.

Replenishment rates for a minilab C-41 process, using C-41 developer, C-41 bleach II ML and C-41 fixer, are taken as:

| | | |
|---|---|---|
| developer | 39.4 ml/m | (12.0 ml/ft) |
| bleach | 3.9 ml/m | (1.2 ml/ft) |
| fixer | 29.5 ml/m | (9.0 ml/ft) |
| wash | 656.2 ml/m | (200.0 ml/ft) |
| stabilizer | 52.5 ml/m | (16.0 ml/ft) |

The seasoned bleach was made by mixing 1.2 parts bleach with 0.6 parts developer. The fixer was made by mixing 9 parts fixer replenisher and 0.6 parts seasoned bleach. To the fixer for each simulated process 6.7 g/l of silver bromide and 0.35 g/l of silver iodide was added to simulate seasoning with a silver bromoiodide film.

Three model processes were carried out, each process having the following sequence of processing steps:

| Process 1 (modified C-41 process) | Process 2 (conventional C-41 process) | Process 3 (process of the invention) |
|---|---|---|
| develop | develop | develop |
| bleach | bleach | wash |
| fixer | first wash | bleach |
| wash | fixer | wash |
| stabilize | second wash | fixer |
| | stabilize | wash |
| | | stabilize |

In Process 3, all washes were carried out in the same processing tank.

The following parameters were determined for each model process and then compared:

a) the efficiency of electrolytic silver recovery;

b) the rate of fixing;

c) the pH of the bleach; and d) the amount of stain caused by carry over of the bleach in the film.

a) Efficiency of electrolytic silver recovery.

The efficiency of silver recovery was measured using a cell as described in WO-A-91/09159. The cell was connected to a 21 tank and 21 of a model fixer was circulated round the processing tank and the cell at a rate of 21/min by means of a pump. A steady current of 1 A was passed through the cell. 5 ml samples of the fixer were taken at intervals and subsequently analyzed by atomic absorption spectroscopy. The experiment was repeated with fixers from the other two processes, and the results were plotted as shown in FIG. 1.

FIG. 1 illustrates curves of silver against time for the three fixers used in the process models. The triangles indicate the results for Process 1, the circles for Process 2 and the squares for Process 3.

As can be seen from FIG. 1, the efficiency of the fixer from Process 3, the process according to the present invention, is superior to Processes 1 and 2 which correspond to conventional processes, that is, Process 3 was as good as Process 2 but superior to Process 1 for silver recovery.

b) The rate of fixing.

The fixing rate for the film during each process was measured using infrared densitometry. The infrared density of the film against time was measured when it was immersed in each fixer from the three Processes. The apparatus used for this measurement is described in detail in *Journal of Photographic Science*, vol 32, p234ff. However, the lamp was changed for an infrared emitting diode.

The time of fixing was taken to be the time when the density no longer changed. Agitation was by means of gas burst set at 1 burst every 4s. The fixing times for the seasoned C-41 fixers are given in Table 1 below.

TABLE 1

| Process 1 | Process 2 | Process 3 |
|---|---|---|
| 64 ± 2s | 57 ± 2s | 58 ± 2s |

As can be seen from Table 1, Process 3 and Process 2 are faster than Process 1.

c) pH of the bleach.

The pH values of the bleaches of the three Processes were measured using a Radiometer PHM92 fitted with a Corning calomel reference electrode and a EIL glass electrode. The meter was calibrated using standard pH 4.0 and pH 7.0 buffers. The results obtained are shown in Table 2 below.

TABLE 2

| Process 1 | Process 2 | Process 3 |
|---|---|---|
| pH 5.25 | pH 5.26 | pH 5.02 |

The pH values of the bleach in Process 3 is less than that for Processes 1 and 2.

A pH value of 5.25 is the aim for the C-41 process and is achieved by adding acetic acid to the replenisher kit. In order to get this aim pH for Process 3, the amount of acetic acid added to the replenisher can be reduced by 25 ml/l.

This value of 25 ml/l was measured by making up replenishers from the kit with differing amounts of acetic acid, and then making the dilution as before to account for any carry over from the previous tank.

c) Amount of stain.

The model solutions from the three Processes were tested in a small processing machine. Unexposed pieces of KODA- COLOR GOLD 400 film were processed using each of the three processes made from the model solutions and $D_{min}$ densities measured using status M filters in the densitometer. The $D_{min}$ values determined are shown in Table 3.

TABLE 3

| | Process 1 | Process 2 | Process 3 |
|---|---|---|---|
| Red | 0.43 | 0.43 | 0.43 |
| Green | 0.62 | 0.61 | 0.61 |
| Blue | 0.79 | 0.76 | 0.76 |

It is to be noted that there is less density formed in the unexposed areas in Processes 2 and 3 than in Process 1.

Figure 2:
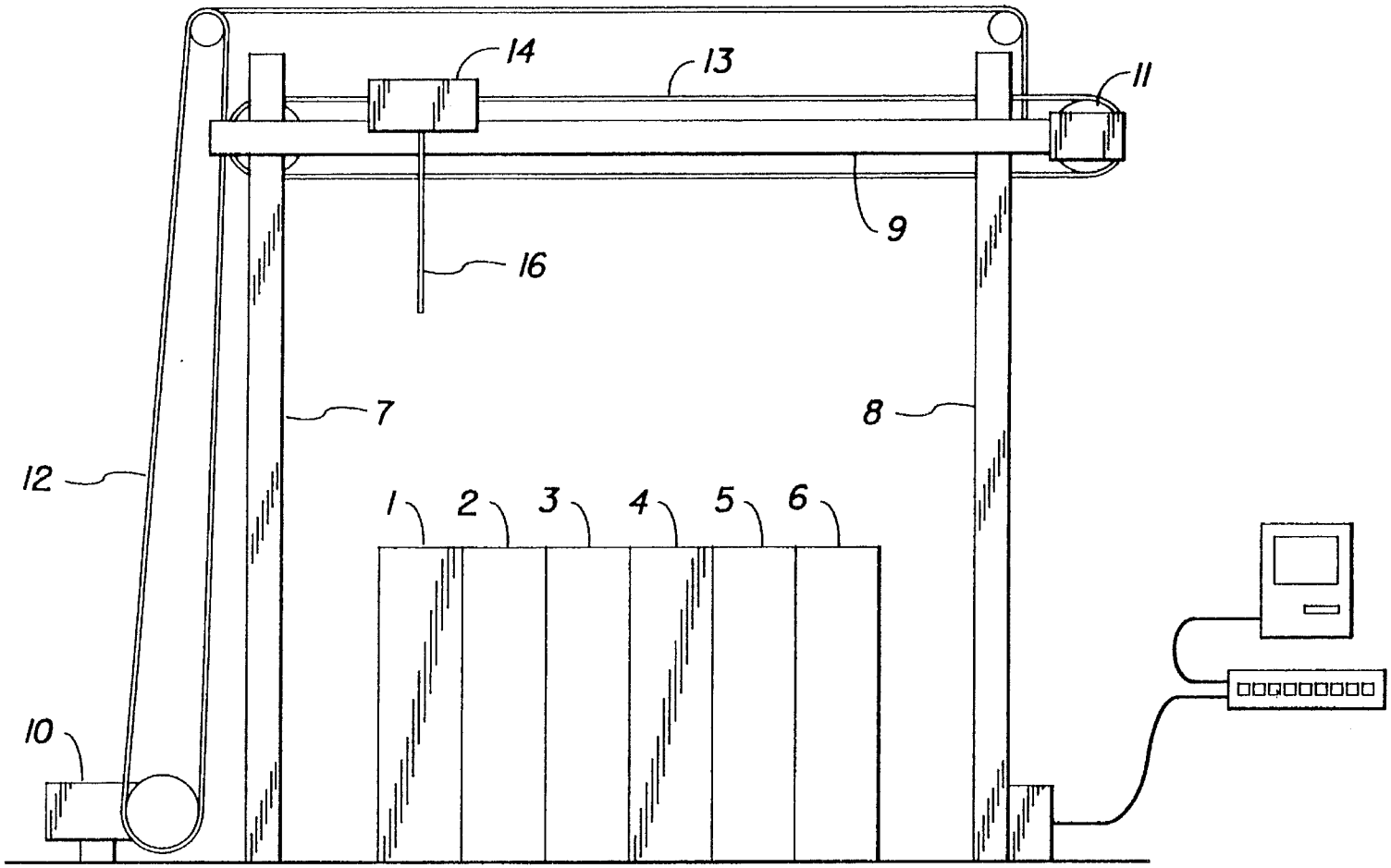
FIG. 2 illustrates a photographic processing apparatus for carrying out the present invention.

FIG. 2 illustrates a photographic processor for carrying out the present invention wherein the process includes processing tanks 1,2,3,4,5,6 wherein a photosensitive material 16 is placed in each of the processing tanks in the desired sequence by a drive and transport mechanism illustrated by numerals 9,10,11,12,13,14. The details of operation are described in U.S. Pat. No. 5,400,104.

From the results obtained by measuring the four parameters as given above, it can readily be seen that Process 3, the process of the present invention, is at least as good (and in some cases better than) Process 2, the conventional C-41 process, with an extra wash step. Furthermore, Process 3 is considerably better than Process 1, the modified C-41 process.

I claim:

1. A method of processing a photosensitive material which comprises at least three different processing steps, said processing steps being carried out in an appropriate tank arranged in a predetermined sequence, each of said tanks having a different processing solution through which the photosensitive material is passed, comprising the steps of:

passing the photosensitive material through said processor such that the photosensitive material is redirected to a previously visited processing tank containing processing solution which is different from the processing solution in the tank it just left.

2. A method according to claim 1 wherein the previously visited processing tank is a wash tank.

3. A method according to claim 1 where said processing steps include a tank containing a developer solution, a tank containing a bleach processing solution, a tank containing a picture processing solution, and a tank containing a wash solution, the method further comprising the step of passing said photosensitive material at least through said wash tank three times.

* * * * *